US012490788B2

(12) United States Patent
Li

(10) Patent No.: US 12,490,788 B2
(45) Date of Patent: Dec. 9, 2025

(54) WEARABLE BLANKET

(71) Applicant: Eric Li, Chino Hills, CA (US)

(72) Inventor: Eric Li, Chino Hills, CA (US)

( * ) Notice: Subject to any disclaimer, the term of this patent is extended or adjusted under 35 U.S.C. 154(b) by 0 days.

(21) Appl. No.: 18/434,169

(22) Filed: Feb. 6, 2024

(65) Prior Publication Data

US 2025/0248466 A1 Aug. 7, 2025

(51) Int. Cl.
*A41D 15/00* (2006.01)
*A41D 15/04* (2006.01)
*A41D 27/20* (2006.01)

(52) U.S. Cl.
CPC ..... *A41D 15/04* (2013.01); *A41D 27/20* (2013.01); *A41D 2300/30* (2013.01)

(58) Field of Classification Search
CPC ..... A41D 15/04; A41D 27/20; A41D 2300/30
See application file for complete search history.

(56) References Cited

U.S. PATENT DOCUMENTS 346,006 A * 7/1886 Williamson ..... A41D 15/02 296/81
672,731 A * 4/1901 Conley ..... A41D 15/04 224/156
2,024,044 A * 12/1935 Johnson ..... A41D 15/04 2/88
2,040,029 A * 5/1936 Smutny ..... A41D 15/04 2/89
2,242,130 A * 5/1941 Hutchison ..... A47G 9/066 2/69.5
2,642,865 A * 6/1953 Mcgann, Jr. ..... A41B 13/06 128/873

(Continued)

FOREIGN PATENT DOCUMENTS

CN 201480824 U 5/2010
CN 112140660 A 12/2020

(Continued)

OTHER PUBLICATIONS

"Wholesale USB Electric Portable Throw Sherpa Wearable Heated Blanket for Winter," alibaba.com. https://www.alibaba.com/product-detail/Wholesale-USB-Electric-Portable-Throw-Sherpa_1600736855114.html?spm=a2700.galleryofferlist.normal_offer.d_title.428d373dBEJyEa [Date accessed: Oct. 13, 2023].

(Continued)

*Primary Examiner* — Richale L Quinn

(74) *Attorney, Agent, or Firm* — Bold IP, PLLC; Maki Imakura; Houda El-Jarrah

(57) ABSTRACT

A wearable blanket that is usable in a variety of different configurations whereby the blanket has a central waist slit, a drawstring or belt, and one or more fasteners, wherein the blanket does not comprise a hood or sleeves, and wherein the blanket is wearable by a user by pulling the blanket down from a head of the user or up from feet of the user through the central waist slit, securing the blanket around a waist area of the user by cinching the drawstring or belt, and securing the blanket on shoulders of a user with the one or more fasteners. The blanket is adjustable with the one or more fasteners to accommodate different sized users, and can be worn in different ways, and also can be secured behind the legs to ensure blanket coverage behind the legs. The blanket also has conveniently located pockets for storing items.

20 Claims, 6 Drawing Sheets

(56) References Cited

U.S. PATENT DOCUMENTS 2,644,948 A * 7/1953 Gutmann ..... A47G 9/086 5/413 R
2,717,390 A * 9/1955 Houze ..... A41D 15/00 2/88
2,722,694 A * 11/1955 Bryant ..... A61F 5/3776 2/69.5
2,967,306 A * 1/1961 Fabanich ..... A41D 3/08 2/87
3,079,611 A * 3/1963 Boryszewski ..... A41D 7/008 2/89
3,381,306 A * 5/1968 Innes ..... A47G 9/086 5/413 R
3,522,612 A * 8/1970 Palmer ..... A41D 15/00 2/84
3,571,810 A * 3/1971 Swett ..... A41D 7/00 2/69
3,597,764 A * 8/1971 Povey ..... A41D 15/04 2/69.5
4,507,805 A * 4/1985 Calutoiu ..... A41D 15/04 5/413 R
4,656,670 A * 4/1987 Schluter ..... B60N 2/60 2/92
5,463,783 A * 11/1995 Pope ..... A45F 4/02 2/88
6,003,749 A * 12/1999 Sabo ..... F41H 3/02 2/919
6,275,993 B1 * 8/2001 McCarley ..... A41D 15/04 2/84
6,341,379 B1 * 1/2002 Kokus ..... A41D 15/04 2/89
6,532,595 B1 * 3/2003 Holmes ..... A41B 13/00 2/48
6,851,127 B1 * 2/2005 Khan ..... A47G 9/066 2/84
D507,693 S * 7/2005 Walton ..... D2/825
7,003,825 B1 * 2/2006 Levings ..... A47G 9/066 296/81
7,178,185 B1 * 2/2007 Nattler ..... A41D 15/04 2/84
7,647,656 B2 * 1/2010 Smith ..... A41D 15/04 5/413 R
7,752,690 B1 * 7/2010 Seth ..... A47G 9/086 5/413 R
8,464,374 B1 * 6/2013 Thayer ..... A45F 4/12 5/413 R
9,161,640 B2 * 10/2015 Široký ..... A47G 9/0223
9,380,815 B2 * 7/2016 Toro-Gerstein ..... A41D 1/215
9,433,245 B2 * 9/2016 Elsmo ..... A41D 3/08
9,700,086 B2 * 7/2017 Gamble ..... A41D 15/00
9,763,485 B1 * 9/2017 Weitala ..... A41D 3/08
9,867,409 B1 * 1/2018 Mróz ..... A47C 31/11
D839,546 S * 2/2019 Noiberg ..... D2/826
10,306,938 B2 * 6/2019 Kingsmore ..... A47G 9/066
10,681,997 B1 * 6/2020 Rigas ..... A47C 31/11
D911,673 S * 3/2021 McManus ..... D2/826
D913,015 S * 3/2021 Dann ..... D6/603
D917,130 S * 4/2021 Rahman ..... D2/851
11,051,562 B2 * 7/2021 Rundle ..... A41D 3/08
D984,091 S * 4/2023 Chen ..... D2/823
11,930,868 B2 * 3/2024 Zlotkin ..... A47G 9/064
2004/0237167 A1 * 12/2004 Curry ..... A41D 3/08 2/88
2006/0277655 A1 12/2006 Kerr
2008/0066229 A1 * 3/2008 Auer ..... A41D 3/08 2/84
2008/0250560 A1 * 10/2008 Armstrong ..... A47G 9/068 5/482
2008/0271222 A1 11/2008 Nienow
2009/0294075 A1 * 12/2009 Huck ..... A63H 33/008 160/382
2010/0146680 A1 * 6/2010 Cuoco ..... A41D 3/08 2/84
2011/0258749 A1 * 10/2011 Hibbs ..... A41D 15/04 2/84
2012/0005801 A1 * 1/2012 Parr ..... A41D 3/00 2/84
2012/0060254 A1 * 3/2012 Blade ..... A41D 15/04 2/69
2013/0219616 A1 * 8/2013 Bozek ..... A47G 9/066 5/482
2019/0246712 A1 * 8/2019 Sonksen ..... A47G 9/064
2021/0137187 A1 * 5/2021 Grimes ..... A47G 9/064
2023/0090869 A1 * 3/2023 Pearse-Danker ..... A41D 15/04 2/69.5

FOREIGN PATENT DOCUMENTS

CN 218219799 U 1/2023
TW M593222 U 4/2020

OTHER PUBLICATIONS

"Wearable Blanket Soft Shawl Button Closure Warm Snuggle Throw for sofa blanket for knee or shoulder All Season Available," alibaba.com. https://www.alibaba.com/product-detail/Wearable-Blanket-Soft-Shawl-Button-Closure_1600485144047.html?spm=a2700.galleryofferlist.normal_offer.d_title.5db6373dPohAtA [Date accessed: Oct. 13, 2023].
"Custom Luxurious Soft Plush Fleece Shawl Sofa Warm Scarves Blankets Women Ladies Wearable Throw Blanket With Foot Pocket," alibaba.com. https://www.alibaba.com/product-detail/Custom-Oversized-Luxurious-Soft-Plush-Fleece_1600758477630.html?spm=a2700.galleryofferlist.normal_offer.d_title.5db6373dPohAtA [Date accessed: Oct. 13, 2023].
"TOPKO High Quality Flannel Electric Blanket Heated Blankets For Winter Household Portable Electric Heated Blanket," alibara.com. TOPKO High Quality Flannel Electric Blanket Heated Blankets For Winter Household Portable Electric Heated Blanket [Date accessed: Oct. 13, 2023].
International Search Report and Written Opinion of the International Searching Authority for international application No. PCT/US24/14886, May 17, 2024.

* cited by examiner

WEARABLE BLANKET

FIELD OF THE DISCLOSURE

The present invention relates generally to a blanket and more particularly to a wearable blanket that may be used as a traditional blanket covering that may also be worn on the user or wearer.

BACKGROUND

There are many types of blankets that have been designed to keep one warm and cozy while lounging or active at home. When it gets cooler, people like to cover themselves with a blanket, wear insulating clothing, put on another layer, etc. There are wearable blankets that have added features such as sleeves, pockets, and hoods to allow for movement and activities. However, such features can add bulk to the blanket, be cumbersome to wear, and look more like a robe or oversized pullover than a traditional throw blanket for covering. They are also too oddly shaped with multiple layers in some parts to be comfortably used as a regular throw or blanket. Blankets without the above features achieve the desired results only when a user is motionless in a sitting or reclined position on furniture where the furniture is partially insulating the back side of the user. When the user gets up or moves around, the blanket is less effective as some portions of the user on the front side and or the back side are exposed and the user's hands are holding onto the blanket, making it difficult move and extend the arms of the user.

Accordingly, there is a need for a blanket that can be used both as a covering and for wearing that is not cumbersome to use yet still allows for movement without sacrificing warmth.

SUMMARY

The present description includes one or more non-limiting embodiments for an apparatus in the form of a wearable blanket that provides warmth and stays secure during movement. In a non-limiting embodiment, the wearable blanket may include a single, whole body that further comprises a central slit integrated into a central area of the body of the wearable blanket and parallel to the top and bottom sides. In a non-limiting embodiment, the central slit may be off center. In a non-limiting embodiment, there may be two slits wherein the central or off-center slit is parallel to another smaller slit that is integrated between the central or off-center slit and the top side of the single body. In a non-limiting embodiment, the central or off-center slit is large enough for the user to slip inside placing the slit roughly around the waist. The central waist slit maybe placed at the waist, above the waist, or below the waist to suit the user such that the wearable blanket ends where the user desires and does not drag on the floor while the user is walking. In a non-limiting embodiment, the smaller slit is large enough and positioned for the user to put their head through the smaller slit in addition to their waist in the central or off center slit.

In some embodiments, the central slit may comprise a hem or casing to enclose a drawstring, elastic, belt, or the like that can be tightened to make the slit smaller and thus more secure around the waist. In some embodiments, instead of or in addition to the casing, there may be loops or the like to enclose a drawstring, belt, or the like to be tightened to make the slit smaller. In some embodiments, one or more pockets may be placed below and near the central slit so as to be positioned roughly on the hips and/or upper thighs while in use by a user. In non-limiting embodiments, one or more fasteners, such as toggles and loops, line the periphery of the central slit to enable securing closed the central slit so as to not expose any body parts of the user when the wearable blanket is used as a covering rather than being worn. Alternatively, there is an extra flap of material so as to overlap and cover the central slit. The extra flap of material may be sewn in on one end the flap on one side of the central slit and fastenable with one or more fasteners on the other side of the extra flap of material and the other side of the central slit.

In a non-limiting embodiment, there are one or more fastening mechanisms along the sides of the single body, particularly on the top side towards the corner ends and/or the sides toward the top corner ends for securing the blanket on the shoulders of the user. The top side of the single body may be folded over to create a collar and then secured over the shoulders of the user as well. Creating a collar additionally makes the upper portion of the wearable blanket less loose about the upper torso, such as for shorter users and children. In addition, there may be one or more fastening mechanisms on the sides towards the lower portion of the wearable blanket for securing the wearable blanket around the legs. The one or more fasteners on the lower portion of the wearable blanket may also be used to adjust the length of wearable blanket such that the bottom side of the wearable blanket may fall at the knees of the user, the ankles or feet of the user, or anywhere between the knees and the ankles or feet of the user. The wearable blanket may be adjusted using the one or more fasteners or may naturally fall to the knees of the user, the ankles or feet of the user, or anywhere between the knees and the ankles or feet of the user. The user may roll or fold upwards, away or towards the body of the user, a lower portion of the wearable blanket and secure with the one or more fasteners to adjust where the bottom edge of the wearable blanket falls on the user's body. The central waist slit may be secured closed when used as a traditional covering by fastening fasteners on the periphery of the central waist slit or an extra flap of material overlapping the central waist slit that is sewn in on one side and secured closed with fasteners on the overlapping material and the lower periphery of the central waist slit.

The one or more fastening mechanisms may be along the edge or near the edge, such as one to two centimeters from the edge. The one or more fasteners may be in one or more rows, such as for a double-breasted trench coat, or in selective locations for style and comfort. The one or more fastening mechanisms may comprise buttons, snap buttons, eyelets, hooks and loops, toggles and loops, magnets, zippers, or the like. The one or more fastening means on the lower portion of the wearable blanket are preferably magnets stitched into the fabric or magnets covered by fabric.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

Other aspects and advantages of the invention will be apparent from the following description and the appended claims.

DETAILED DESCRIPTION

The present description is drawn to a novel and unique wearable blanket that incorporates a selectively designed slit to provide a hole through which a user's body fits through to wear the wearable blanket with the slit on the user's waist and the upper part of the blanket secured around the user's upper body with fasteners. It is noted that the wearable blanket may be worn in different ways or used as a regular blanket covering as desired by the user.

In accordance with non-limiting embodiments, the wearable blanket can be secured on a user's body during sedentary times as well as during activity, such as working on a computer, playing games, watching television, doing crafts, etc. The wearable blanket can be draped over the user or secured in multiple ways so as to suit the user's needs. The wearable blanket can provide warmth to the user while sitting or standing still and during movement, such as walking and doing some activity involving the upper body and/or lower body. The wearable blanket, in addition to freeing the hands from holding the blanket in place, allows the user to move freely and without having the blanket fall off the shoulders, shift in position, or otherwise exposing the user's body in an undesired way. Advantageously, the positioning of the fasteners allows the user to wear the blanket in many ways for comfort and/or fashion and the included pockets allow the user to store items, such as tools, phones, keys, etc. inside of the included pockets. Further details are provided with reference to the Figures.

Figure 1:
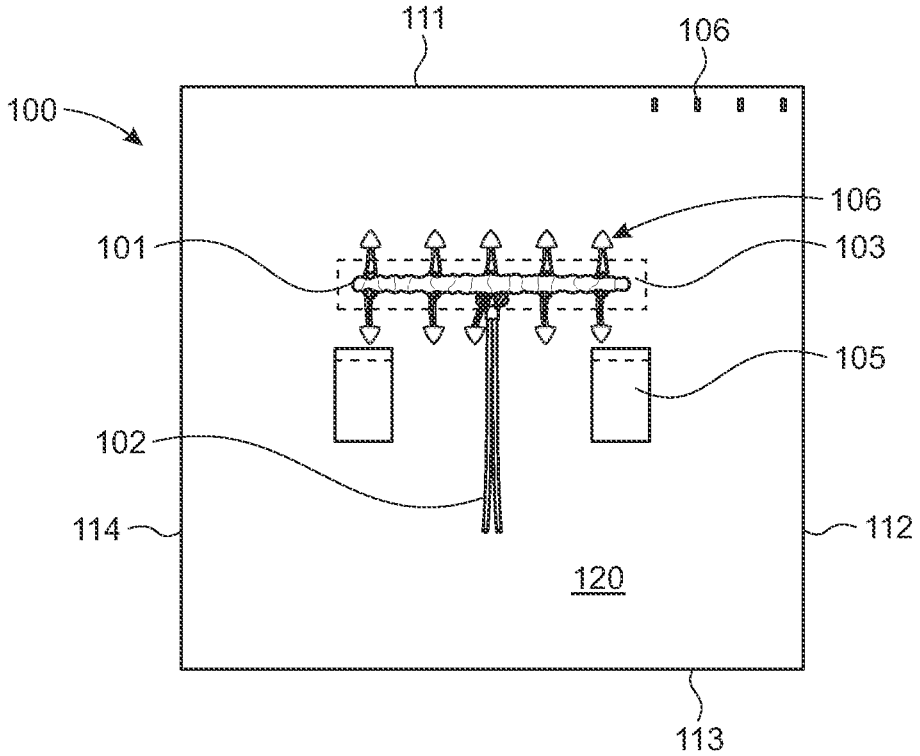
FIG. 1 depicts a pictorial illustration of a front side of an exemplary wearable blanket.
Figure 2:
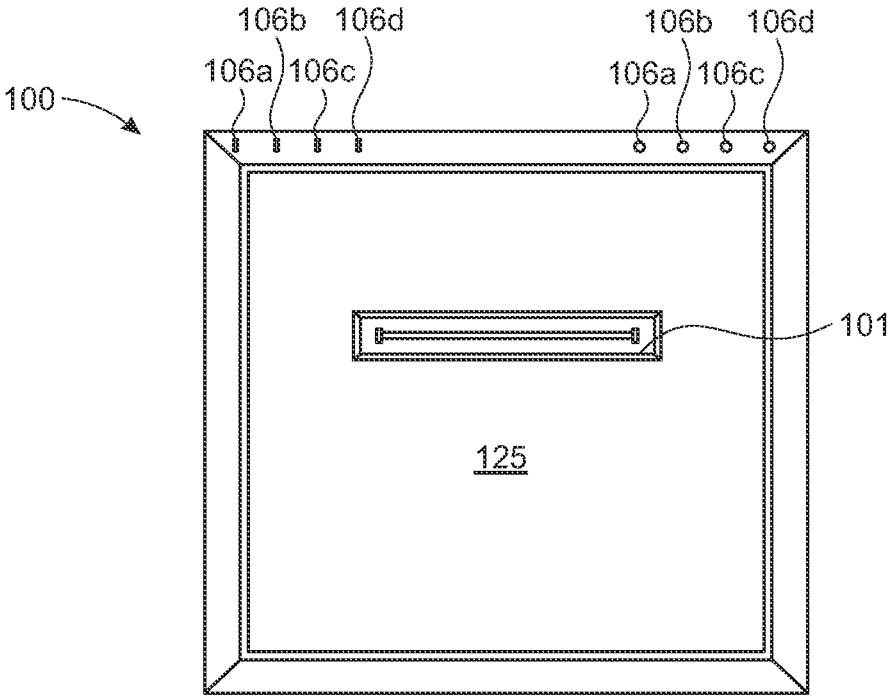
FIG. 2 depicts a pictorial illustration of a back side of the exemplary wearable blanket shown in FIG. 1.
Figure 5A:
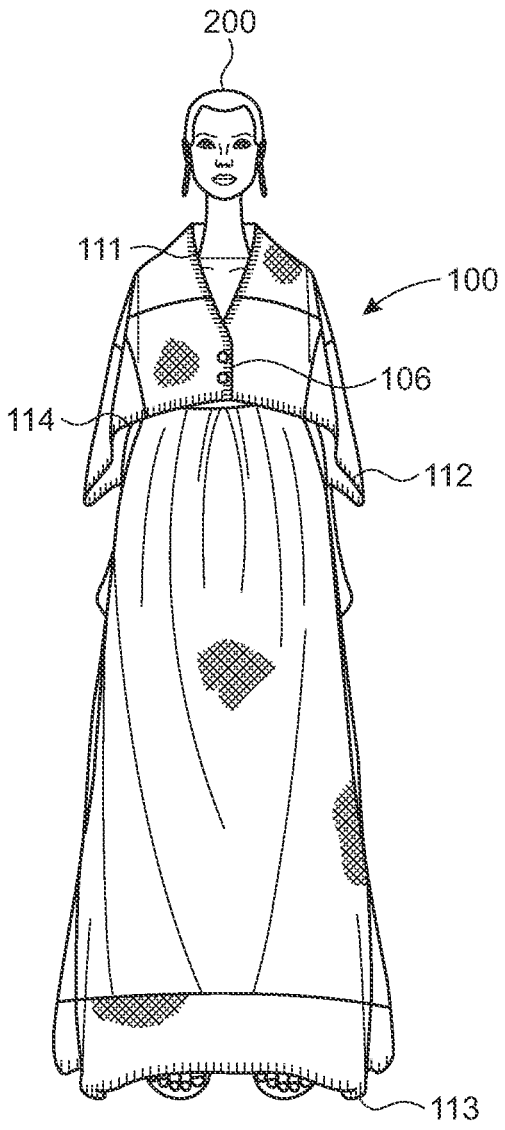
FIG. 5A depicts a pictorial illustration of a user wearing a wearable blanket.

FIG. 1, shows a pictorial illustration of a front side 120 of a wearable blanket 100 and FIG. 2 shows a pictorial illustration of a back side 125 of the wearable blanket 100 that provides coverage and warmth to a user 200 according to one or more non-limiting embodiments. Wearable blanket 100 may be used anywhere a traditional blanket would be used as a covering, such as at a home, event, etc. Wearable blanket 100 may be used in any application or location where user 200, as shown in FIG. 5A in an example, would benefit from coverage and warmth of wearable blanket 100. Generally, the right half of wearable blanket 100 is symmetrical to the left half of wearable blanket 100. However, some features, such as fasteners and images/patterns on the material, may not be symmetrical on the right and left halves. Notably, wearable blanket 100 is devoid of features such as hoods and sleeves.

Wearable blanket 100 may be a large, rectangular shaped blanket as shown in FIG. 1 in a non-limiting embodiment made of a single, whole, continuous body. In other embodiments, wearable blanket 100 may be square-shaped or any other shape and may be made having a variety of sizes. Wearable blanket 100 is preferably at least as large as a typical height of an average adult user. Wearable blanket 100 may be as large as a typical height of an average child user. Thus, the size of wearable blanket 100 may vary. The term wearable blanket 100 may interchangeably be referred to as a "blanket" as well.

Figure 3:
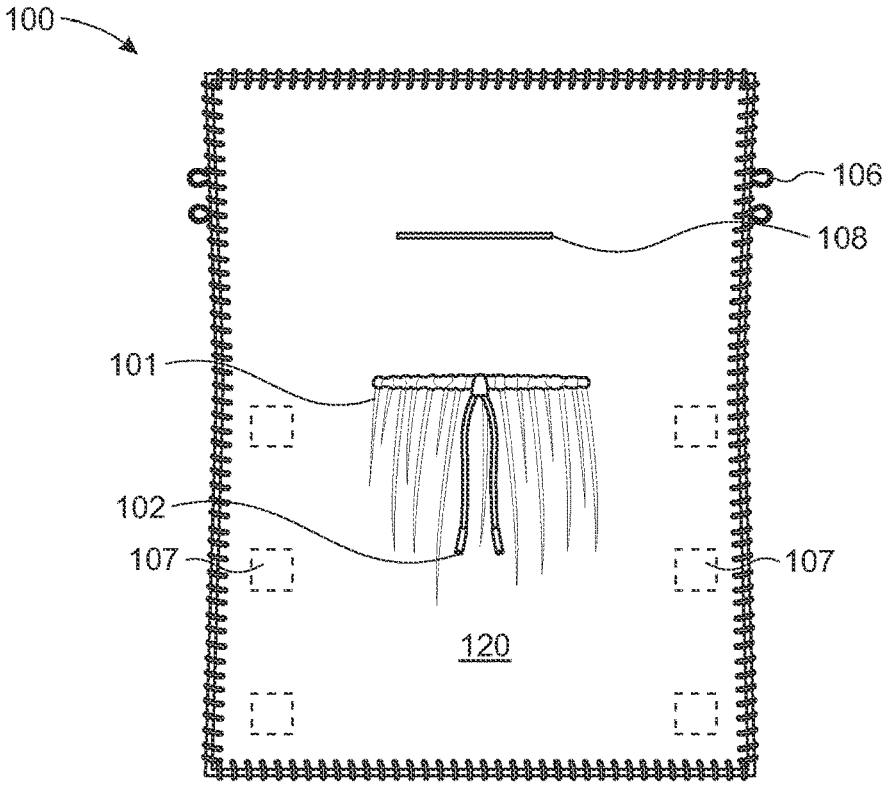
FIG. 3 depicts a pictorial illustration of a front side of an exemplary wearable blanket with the drawstring tightened.

Wearable blanket 100 may be uniform and generally made up of one continuous piece in a preferred non-limiting embodiment. In other embodiments, wearable blanket 100 may be made up of one or more pieces that are layered or stitched together. Wearable blanket 100 may be made of various textiles, such as but not limited to cotton, wool, polyester, etc. Various colors, patterns, logos, images, etc. may also be incorporated on wearable blanket 100. There may be functional and ornamental stitching, as shown in FIG. 2 for the back side 125. There may be stitching around the perimeter of wearable blanket 100 as shown in FIG. 3. Thus, wearable blanket 100 may have different ornamental styles based on the type of material and stitching as shown in the various figures.

In some embodiments, wearable blanket 100 includes a top side 111, right side 112, bottom side 113, and left side 114 as shown in FIG. 1. Further, in some non-limiting embodiments, wearable blanket 100 has a waist slit 101 located or integrated into a central area of wearable blanket 100 and parallel to the top and bottom edges. The central waist slit 101 may be located in the center or off-center of wearable blanket 100. The central waist slit 101 is sized to fit around the waist of an average user 200, and preferably, large enough for user 200 to slip their legs into waist slit 101 and pulled up to the waist area with ease. In non-limiting embodiments, the perimeter of waist slit 101 comprises a hem or casing 103 that encloses a removable drawstring or belt 102. In some embodiments, drawstring or belt 102 is permanently secured so as to not be removable. In some embodiments, instead of or in addition to the hem or casing 103, there are belt loops 104 around the perimeter of waist slit 101 through which a drawstring or belt 102 may loop through. When a user 200 has the waist slit 101 positioned about user 200's waist, user 200 may tighten and secure the waist slit 101 by pulling on drawstring or belt 102 as desired.

User 200 may position waist slit 101 at the waist, above the waist, below the waist, or anywhere the user 200 desires and adjust where the bottom side 113 falls to on the user 200. For example, a wearable blanket 100 worn by an average sized adult user 200 may place the waist slit 101 at the waist of the user 200, but may place the waist slit 101 lower than the waist to make the bottom side 113 fall lower than when the waist slit 101 is placed at the waist to accommodate users with longer legs. A child user 200 wearing a wearable blanket 100 meant for an average sized adult user 200 may adjust the waist slit 101 higher than the waist to accommodate the smaller height of a child user 200. Alternatively, a wearable blanket 100 may be sized for a child user 200 such that the wearable blanket 100 is sized smaller than for an average adult user 200 and the child user 200 can comfortably use wearable blanket 100 with the waist slit 101 placed at their waist without wearable blanket 100 dragging on the floor.

In non-limiting embodiments, as shown in FIG. 3, wearable blanket 100 may have a second slit 108 in addition to waist slit 101. This second slit 108 is smaller than waist slit 101 so as to be able to pull one's head through the second slit 108. Further, the second slit would be parallel to and located between top side 111 and waist slit 101 of the wearable blanket 100.

In non-limiting embodiments, wearable blanket 100 has one or more pockets 105 located near waist slit 101 and between waist slit 101 and bottom side 113. The one or more pockets 105, as shown in FIG. 1, that are located conveniently so as to fall or rest on or near the hip to upper thigh area of user 200 when wearable blanket 100 is being worn. Pockets 105 may be sized to conveniently carry keys, smartphones, snacks, etc.

Figure 4A:
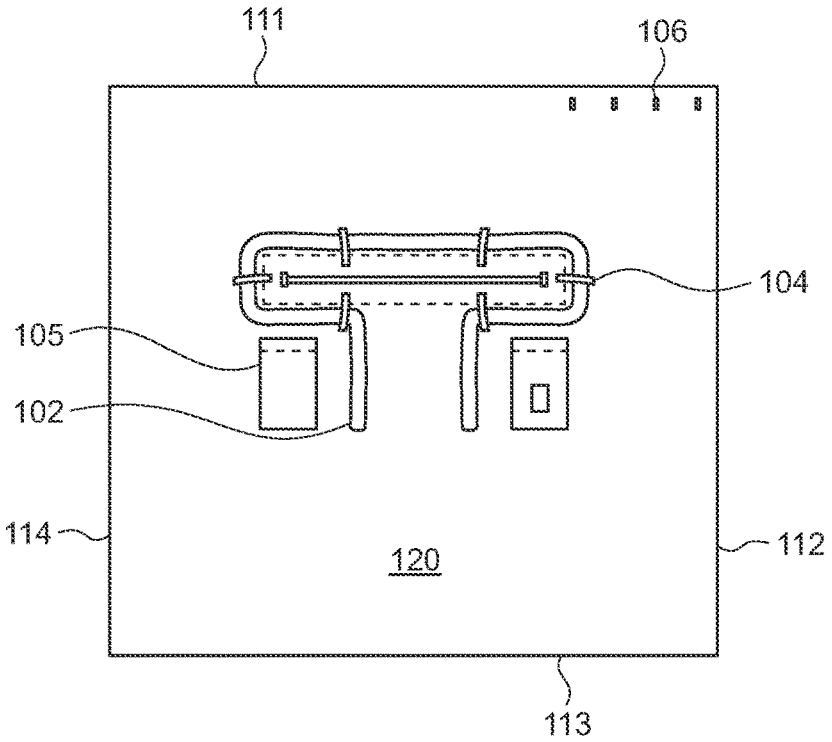
FIG. 4A depicts a pictorial illustration of a front side of an exemplary wearable blanket with loops.
Figure 4B:
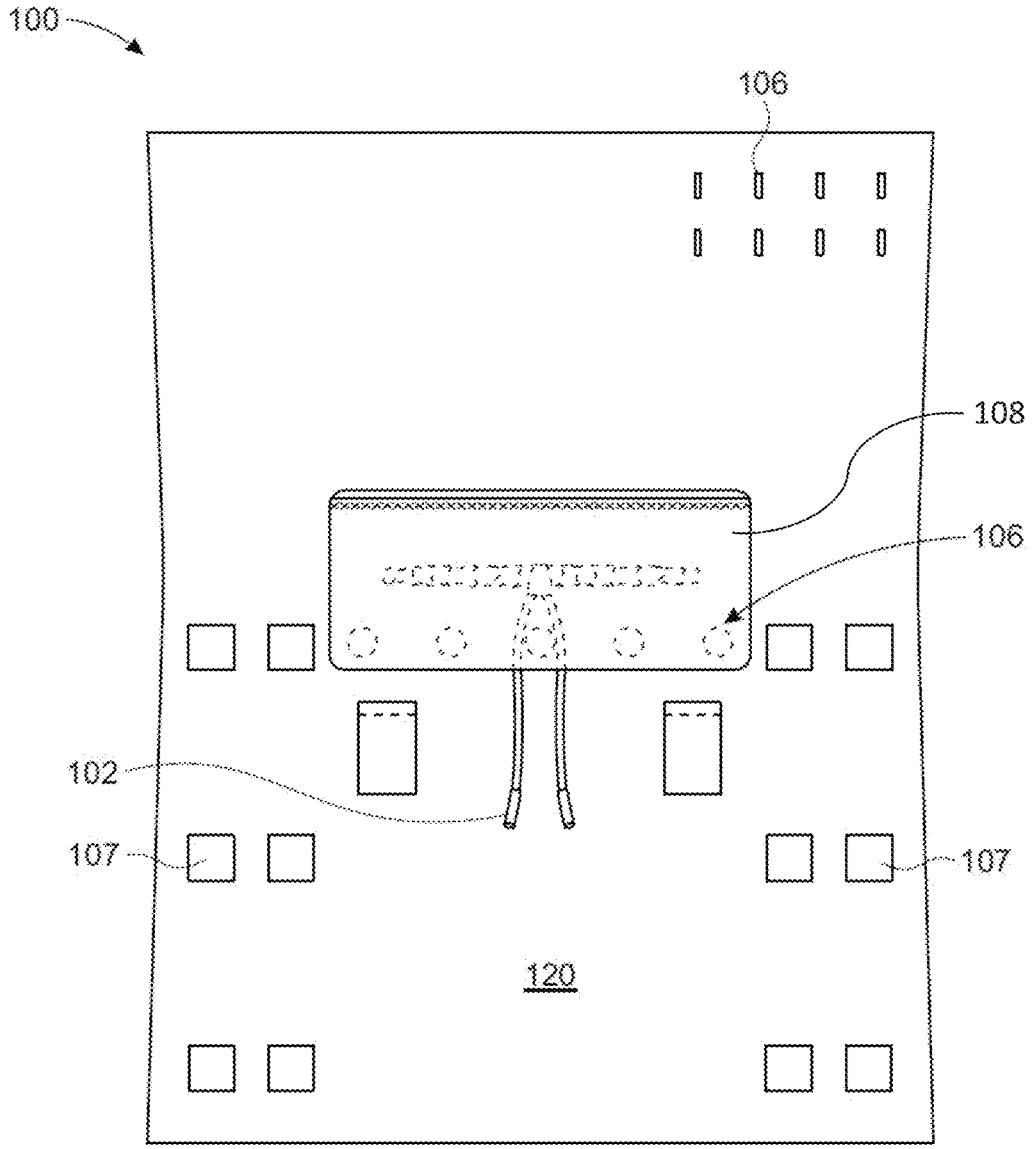
FIG. 4B depicts a pictorial illustration of a front side of another exemplary wearable blanket with an extra flap covering the central waist slit.

In non-limiting embodiments, as shown in FIG. 1 and FIG. 2, wearable blanket 100 comprises fasteners 106 along top side 111 and more towards the corners on top side 111, such as fasters 106*a*, 106*b*, 106*c*, and 106*d*. In some non-limiting embodiments, as shown in FIG. 3, there are fasteners 106 located on right side 112 and left side 114 more toward top side 111 instead of or in addition to the fasteners 106 along top side 111. In some embodiments, fasteners 106 may be in one or more rows as shown in FIG. 4B. Fasteners 106 positioned near top side 111 are used to fasten wearable blanket 100 in the chest area over and around the shoulders of user 200, as shown in FIG. 5A. In some embodiments with more than one row of fasteners 106, a double-breasted look may be achieved, such as with classic trench coats.

In non-limiting embodiments, fasteners 106 are located on the periphery of central waist slit 101. As shown in FIG. 1, five toggle fasteners 106 are on the periphery of central waist slit 101 to enable user 200 to close the central waist slit 101 when wearable blanket 100 is used as a traditional blanket covering so as to prevent undesired exposure of the body of user 200. In some embodiments, shown in FIG. 4B, wearable blanket 100 has an extra flap of material 108 sewn on one side of central waist slit 101 and fasteners 106 line the other side of the extra flap of material 108 and on the other side of central waist slit 101 so as to cover and secure central waist slit 101 closed.

Further, as shown in a non-limiting embodiment in FIG. 3, fasteners 107 may be located on right side 112 and left side 114 spaced out between central waist slit 101 and bottom side 113 of wearable blanket 100. Fasteners 107 positioned between central waist slit 101 and bottom side 113 are used to fasten wearable blanket 100 around and behind the legs of user 200.

In the embodiments shown in the figures, FIG. 1 has four fasteners on the top side 111, FIG. 3 has two fasteners on each side above waist slit 101 and three fasteners on each side below waist slit 101, and FIG. 4B has double rows of fasteners 106 on the top side 111 and double rows of fasteners 107 on each side below the central waist slit 101. Additionally, fasteners 106 to secure central waist slit 101 closed in two different ways are shown in FIG. 1 and FIG. 4B around the periphery of central waist slit 101. However, other embodiments of wearable blanket 100 may have more or less number of fasteners than shown in the figures.

Fasteners 106, 107 may comprise, but are not limited to, segments of hook and loop fasteners (e.g., VELCRO), toggles and loops, buttons and buttonholes, snap buttons, ties, magnets, zippers, or any other forms of attachment mechanisms known to one of ordinary skill in the art. Fasteners 106, 107 may be positioned on the edges, such as along the periphery of central waist slit 101, top side 111, right side 112, and left side 114 in any number, spacing, and combination such that there may be fasteners 106 only along topside 111, only on right side 112 and left side 114, or both in any combination. In some embodiments, fasteners 106, 107 may be in multiple rows and any distance away from the periphery of central waist slit 101, top side 111, right side 112, and left side 114 while still being relatively close to central waist slit 101, top side 111, right side 112, and left side 114, respectively. The fasteners toward the right side 112 have mating halves on the left side 114. The fasteners 106 on the top periphery of central waist slit 101 and/or on the extra flap of material have mating halves on the bottom periphery of central waist slit 101. By selecting certain fasteners that correspond together of a fastener pair of the multiple fasteners 106, 107 on the wearable blanket 100, users 200 can adjust the wearable blanket 100 in multiple ways to suit the user according to different user sizes and different styles and comfort.

Figure 5B:
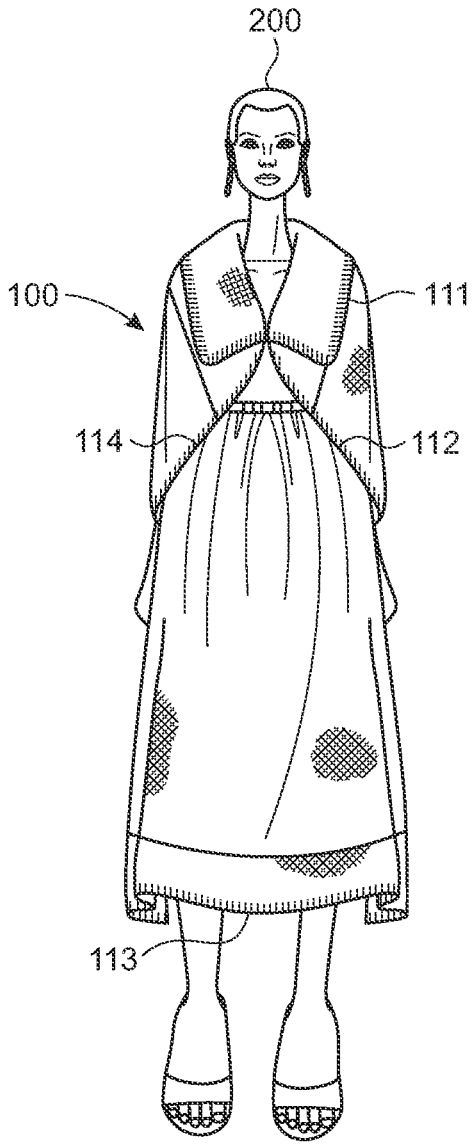
FIG. 5B depicts a pictorial illustration of a user wearing a wearable blanket at a shorter length.

Wearable blanket 100 is worn by a user 200 by putting user 200's body through the central waist slit 101 and positioning the central waist slit 101 around the waist. User 200 has the option to tighten the central waist slit 101 around user 200's waist as desired by pulling or cinching the drawstring or belt 102. FIG. 3 shows drawstring 102 pulled so as to tighten the central waist slit 101 area and thereby shortening the width of wearable blanket 100 in that area. The top part of wearable blanket comes up from behind and over the shoulders of user 200. In some embodiments, the top edge of wearable blanket 100 touches the neck of the wearer and drapes down over the neck and chest area as shown in FIG. 5A. The one or more fasteners 106 may then be fastened to secure wearable blanket 100 around the upper torso. In some embodiments, the top edge of wearable blanket 100 may be folded over and then draped over the shoulders so as to create a collared look or a double layer over the neck, shoulders, and chest area, which is shown in FIG. 5B. A portion of wearable blanket 100 parallel to top edge 111 may be folded in the direction away from user 200 and then put up and over the shoulders of user 200 so as to have the corner portions of top edge 111 drape over the chest area of user 200 to form the collared look. Additionally, the folding of the material to form a collar is a way for user 200 to shorten the length of wearable blanket 100 about the upper torso area. The one or more fasteners 106, 107 may then be fastened to secure wearable blanket around the upper torso. User 200 may select any of the one or more fasteners 106, 107 so as to secure wearable blanket 100 on the user regardless of size of user 200 or whether user 200 desires wearable blanket 200 to be more tightly or loosely secured about user 200's body.

Figure 6A:
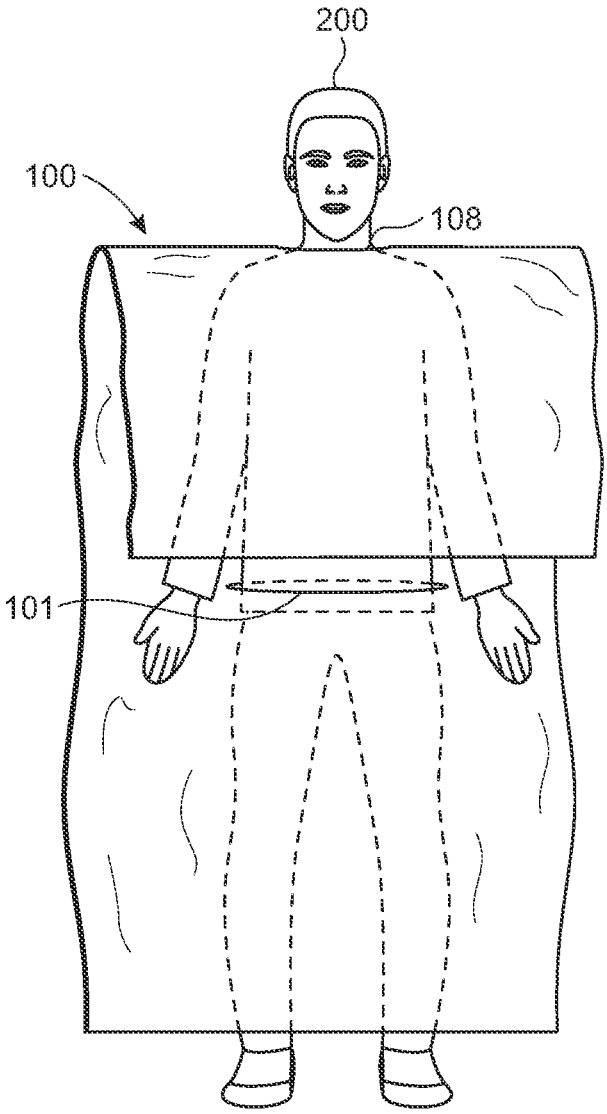
FIG. 6A depicts a pictorial illustration of a user wearing a wearable blanket with a second slit.
Figure 6B:
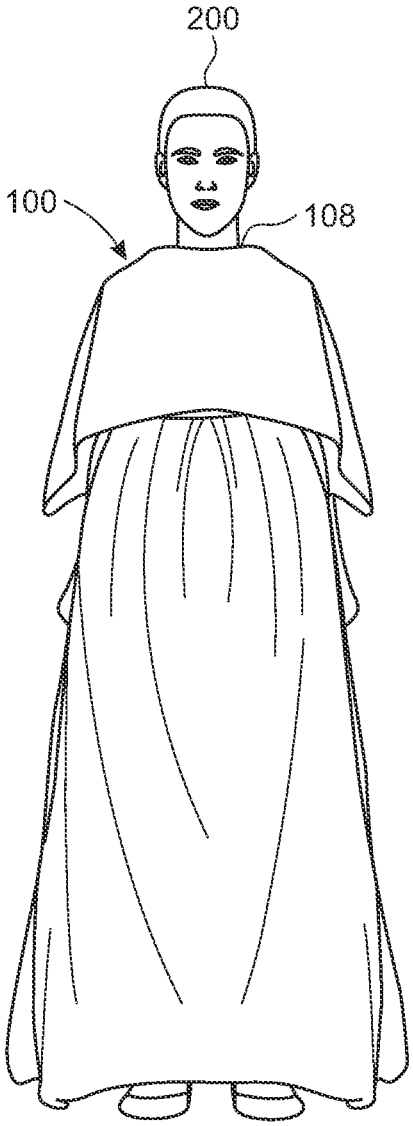
FIG. 6B depicts another pictorial illustration of a user wearing a wearable blanket with a second slit.

In some embodiments where there is a second slit 108, user 200 may put user 200's head through second slit 200, in addition to the steps detailed above, such that wearable blanket drapes over the front of user 200's legs, comes up behind the upper torso of user 200, the head pokes through second slit 108, and the upper portion of wearable blanket 100 drapes over the chest area of user 200 as shown in FIG. 6A and FIG. 6B. FIG. 6A shows the blanket stretched out to show how user 200 fits in the slits. FIG. 6B shows the blanket with the material naturally draping over user 200.

In some embodiments, the lower portion below the central waist slit 101 of wearable blanket 100 covers the front side of the user 200's hips and legs. The length can vary from the bottom edge of wearable blanket 100 hitting about above the knees of user 200 anywhere down to the ankles and/or feet of the user as shown in the different embodiments of FIG. 5A and FIG. 5B. Accordingly, the length of the wearable blanket 100 when worn may preferably stop either above the knees or above the ankles or the feet or anywhere in between the knees and/or ankles and feet of user 200 based on the size and length of wearable blanket 100 and how user 200 positions wearable blanket 100 and uses fasteners 107 to adjust the length of wearable blanket 100 over the lower half of user 200. If desired, the user 200 may roll or fold upward the lower portion of wearable blanket 100 around and behind the posterior and back of the legs and secured by the one or more fasteners 107 located between central waist slit 101 and the bottom edge 113 of wearable blanket 100. FIG. 5A and FIG. 5B show example embodiments of wearable blanket 100 at different lengths being worn by user 200. The wearable blankets 100 may be adjusted to accommodate a user 200 of any height such that the wearable blanket 100 does not drag on the floor while sitting or walking. In some embodiments, user 200 may not fold, roll up, or otherwise adjust the length of the material below the central waist slit 101 and simply just wrap the right side 112 and the left side 114 around the legs and fasten fasteners 107 such that the wearable blanket 100 wraps around the legs. The one or more fasteners 107 used to secure wearable blanket 100 around the legs are preferably magnets that are sewn into or magnets covered in fabric attached to the material of wearable blanket such that user 200 can bring the material close to each other and the magnets attract and automatically fasten without user 200 having to reach down and secure the material together.

Figure 7:
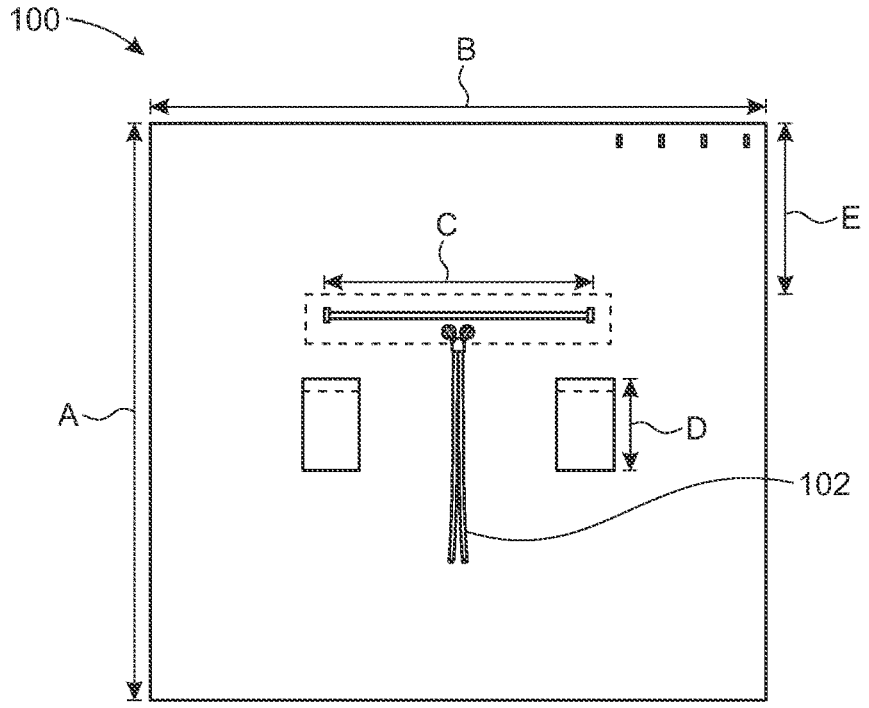
FIG. 7 depicts some exemplary dimensions for the wearable blanket.

FIG. 7 shows an exemplary wearable blanket with some exemplary, non-limiting dimensions for clarification. In a non-limiting embodiment, the length A of wearable blanket 100 may be approximately 190 centimeters (cm) (75 inches) while the width B may be approximately 152 cm (60 inches). In a non-limiting embodiment, the distance E from top side 111 to waist slit 101 may be approximately 81 cm and the width C of waist slit 101 may be approximately 86 cm.

In some non-limiting embodiments, pockets 105 may be 15 cm in height D as shown in FIG. 7. Further, the eyelets for hem or casing 103 may be approximately 2 cm in diameter. The drawstring/belt 102 that snakes through casing 103 or loops 104 may be approximately 120 cm in length according to one or more non-limiting embodiments.

Alternatively, in some non-limiting embodiments, wearable blanket 100 may be used as a covering. To ensure no exposure of the body of user 200 from the central waist slit 101, fasteners 106 are located on the periphery of central waist slit 101. FIG. 1 shows fasteners 106 located on the periphery of central waist slit 101 where fasteners 106 on the top periphery of central waist slit 101 fasten to fasteners 106 on the bottom periphery of central waist slit 101. In other words, fasteners 106 on the top periphery of central waist slit 101 fasten to their mating halves on the bottom periphery of central waist slit 101. For example, toggle buttons may line the top periphery of central waist slit 101 and loops may line the bottom periphery of central waist slit 101 and positioned so as to be able to fasten toggle button to loop. In other non-limiting embodiments, there is an extra flap of material 108 that is sewn on the top periphery of central waist slit 101 and fasteners 106 on the other end of the extra flap of material 108 fasten to their mating halves by fastening to fasteners 106 on the bottom periphery of central waist slit 101, shown in FIG. 4B.

Figure 8:
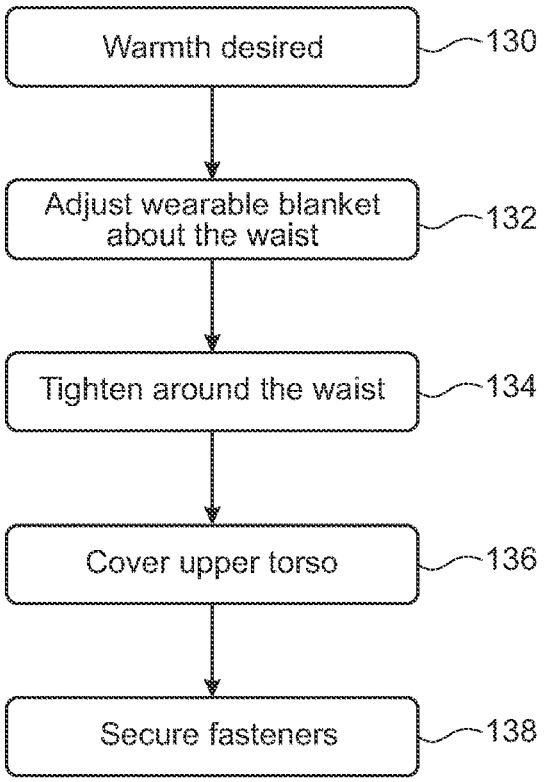
FIG. 8 depicts a flow chart illustrating a method for wearing the wearable blanket.

FIG. 8 depicts a flow chart illustrating an exemplary, non-limiting method for wearing the wearable blanket. In step 130, user 200 desires some additional warmth or generally desires to wear wearable blanket 100. User 200 obtains wearable blanket 100 and, in step 132, inserts either from the feet or the head of user 200 through central waist slit 101 such that central waist slit 101 is positioned bout the waist of user 200. In step 134, user 200 may use drawstring or belt 102 to tighten central waist slit 101 around the waist as desired to secure wearable blanket 100 in the waist area of user 200. In step 136, user 200 covers the upper torso of the user 200 by bringing the material of wearable blanket 100 up behind the back of user 200. At this point, user 200 may bring the corners of top edge 111 over the shoulders of user 200 and drape over the chest area, as shown in FIG. 5A. Alternatively, user 200 may fold over part of the material of wearable blanket 100 parallel to top edge 111 and in the direction away from user 200 such that an upper portion of wearable blanket 100 has two layers of material. User 200 may bring the corners of the folded over material over the shoulders of user 200 and drape over the chest area such that the two-layered portion due to the folding over of material forms a collared type of look as shown in FIG. 5B. Alternatively, if wearable blanket has second slit 108, user 200 may bring the material of wearable blanket 100 up behind the back of user 200 and insert the head of user 200 through second slit 108 and drape the portion of material between second slit 108 and top edge 111 over the chest area of user 200 as shown in FIG. 6A and FIG. 6B. At step 138, user 200 may secure any number, location, and combination of fasteners 106, 107 of wearable blanket 100 to position and secure wearable blanket 100 on the user 200. User 200 may secure any of fasters 106 on top edge 111 as shown in FIG. 5A. User 200 may secure any of fasters 106 on right side 112 and left side 114 as shown in FIG. 5B. Alternatively, user 200 may not secure any of fasteners 106, 107 as shown in FIG. 6A. In addition, user 200 may secure fasteners 107 located between central waist slit 101 and bottom side 113 as shown in FIG. 5A, FIG. 5B, and FIG. 6B to secure wearable blanket 100 around the legs of user 200.

Advantageously, the wearable blanket described above and shown in the figures may be used in multiple ways. As noted above, the wearable blanket offers warmth, adjustability, and style during any number of activities. While preferred and non-limiting embodiments of the present invention have been described, various other adaptations and modifications may be envisioned by those of ordinary skill in the art without departing from the scope and spirit of the invention. Many other advantages and benefits may be provided by the one or more systems and components described herein.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises")

components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted. The term "coupled to" as used herein may refer to a direct or indirect connection.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An apparatus, comprising:

a wearable blanket, the wearable blanket comprising:

a single body that further comprises:

a central waist slit sized for a waist integrated centrally in the single body, not reaching any sides of the single body, and parallel to a top side and a bottom side of the single body;

wherein the central waist slit has no missing material when the single body is laid flat;

wherein the central waist slit comprises a removable drawstring or belt around a perimeter of the central waist slit;

one or more fasteners along the top side of the single body; and one or more fasteners along a right side and a left side of the single body that are spaced out between the central waist slit and the bottom side of the single body.

2. The apparatus of claim 1, wherein the single body does not comprise a hood or sleeves.

3. The apparatus of claim 1, wherein the one or more fasteners on the single body comprise snap buttons, buttons and buttonholes, segments of hook and loop fasteners, toggle buttons and loops, magnets, ties, zippers, or any combination thereof.

4. The apparatus of claim 1, wherein the wearable blanket further comprises one or more fasteners on the right side and the left side of the single body toward the top side of the single body.

5. The apparatus of claim 1, wherein one or more pockets are located near the central waist slit and between the central waist slit and the bottom side of the single body.

6. The apparatus of claim 1, further comprising a hem, casing, or loops for the drawstring or belt to loop through so as to enable tightening of the central slit about a waist of a user.

7. The apparatus of claim 1, wherein the single body is substantially rectangular in shape.

8. The apparatus of claim 1, wherein a length of the single body is adjustable using the one or more fasteners located between the central waist slit and the bottom side, wherein the length between the central waist slit and the bottom side is configured to cover a user from a waist of the user to anywhere between knees of the user to ankles or feet of the user when the user is wearing the wearable blanket.

9. The apparatus of claim 1, wherein a length of the single body is adjustable using the one or more fasteners located along the top side and the right and left sides of the single body, wherein the length between the central waist slit and the top side is configured to cover an upper torso of a user when the user is wearing the wearable blanket.

10. The apparatus of claim 1, further comprising a second slit wherein the second slit is smaller than the central waist slit and parallel to and positioned between the central waist slit and the top side of the single body.

11. The apparatus of claim 1, further comprising one or more fasteners around a periphery of the central waist slit.

12. The apparatus of claim 1, further comprising an extra flap of a material, different or same as a material of the single body, sewn onto an upper periphery of the central waist slit and one or more fasteners on a bottom periphery of the central waist slit and the other side of the extra flap of the material.

13. An apparatus comprising a wearable blanket comprising a single body with a central waist slit sized for a waist parallel to a top side and a bottom side and not reaching any sides of the single body, wherein the central waist slit has no missing material when the single body is laid flat, a removable drawstring or belt around a perimeter of the central waist slit, and one or more fasteners, wherein the wearable blanket does not comprise a hood or sleeves, and wherein the wearable blanket is wearable by a user by pulling the wearable blanket down from a head of the user or up from feet of the user through the central waist slit, securing the wearable blanket around a waist area of the user by cinching the removable drawstring or belt, and securing the wearable blanket on shoulders of a user with the one or more fasteners.

14. The apparatus of claim 13, wherein the user secures the wearable blanket behind legs of the user with the one or more fasteners.

15. The apparatus of claim 13, wherein the one or fasteners on the single body comprise snap buttons, buttons and buttonholes, segments of hook and loop fasteners, toggle buttons and loops, magnets, ties, zippers, or any combination thereof.

16. The apparatus of claim 13, wherein one or more pockets are located near the central waist slit and between the central waist slit and the bottom side of the single body.

17. The apparatus of claim 13, wherein a length of the single body is adjustable using the one or more fasteners located between the central waist slit and a bottom side, wherein a length between the central waist and the bottom side is configured to cover a user from the waist area of the user to anywhere between knees of the user to ankles or feet of the user when the user is wearing the wearable blanket.

18. The apparatus of claim 13, wherein a length of the single body is adjustable using the one or more fasteners located along a top side and right and left sides of the single body, wherein a length between the central waist slit and the top side is configured to cover an upper torso of a user when the user is wearing the wearable blanket.

19. The apparatus of claim 13, further comprising a second slit wherein the second slit is smaller than the central waist slit and parallel to and positioned between the central waist slit and the top side of the single body.

20. The apparatus of claim 13, further comprising one or more fasteners around a periphery of the central waist slit or an extra flap of a material, different or same as a material of the single body, sewn onto an upper periphery of the central waist slit and one or more fasteners on a bottom periphery of the central waist slit and the other side of the extra flap of the material.

* * * * *